US009170047B2

(12) United States Patent
Park et al.

(10) Patent No.: US 9,170,047 B2
(45) Date of Patent: Oct. 27, 2015

(54) STORAGE CONTAINER WITH SENSOR DEVICE AND REFRIGERATOR HAVING THE SAME

(75) Inventors: Nam Ju Park, Suwon-si (KR); Kwon Chul Yun, Gwangju (KR); Man Soon Im, Gwangsan-gu (KR); Jeong Su Han, Suwon-si (KR); Hyo Sang Lee, Osan-si (KR); Ji Hoon Ha, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 854 days.

(21) Appl. No.: 13/067,701

(22) Filed: Jun. 21, 2011

(65) Prior Publication Data

US 2011/0314849 A1 Dec. 29, 2011

(30) Foreign Application Priority Data

Jun. 24, 2010 (KR) ..... 10-2010-0059911

(51) Int. Cl.
*F25D 29/00* (2006.01)
*F25D 25/02* (2006.01)

(52) U.S. Cl.
CPC ..... *F25D 29/005* (2013.01); *F25D 25/025* (2013.01); *F25D 2700/06* (2013.01)

(58) Field of Classification Search
CPC ..... F25D 29/005
USPC ..... 62/125, 129
See application file for complete search history.

(56) References Cited

U.S. PATENT DOCUMENTS

| | | | | |
|---|---|---|---|---|
| 5,426,428 | A * | 6/1995 | Binder et al. | 340/870.17 |
| 7,736,179 | B2 * | 6/2010 | Cook et al. | 439/577 |
| 2004/0135542 | A1 * | 7/2004 | Ito | 320/107 |

FOREIGN PATENT DOCUMENTS

| | | |
|---|---|---|
| KR | 10-0788159 | 12/2007 |
| KR | 10-2009-0001612 | 1/2009 |

OTHER PUBLICATIONS

Horizon Hobby. "Battery Basics." ParkZone. N.p., Jan. 19, 2006. Web. Mar. 2, 2015.*

* cited by examiner

*Primary Examiner* — Jonathan Bradford
(74) *Attorney, Agent, or Firm* — Staas & Halsey LLP

(57) ABSTRACT

A storage container with a sensor device to detect a state of food contained in the storage container and a refrigerator having the same. The sensor device is separably mounted to the storage container. The sensor device includes an electrode terminal usable not only to achieve a charging operation, but also to achieve a salinity measuring operation. Thus, the sensor device has user convenience while having a compact size.

15 Claims, 16 Drawing Sheets

STORAGE CONTAINER WITH SENSOR DEVICE AND REFRIGERATOR HAVING THE SAME

CROSS-REFERENCE TO RELATED APPLICATIONS

This application claims the benefit of Korean Patent Application No. 2010-0059911 filed on Jun. 24, 2010 in the Korean Intellectual Property Office, the disclosures of which are incorporated herein by reference in its entirety.

BACKGROUND

1. Field

Embodiments relate to a storage container with a sensor device capable of detecting a state of food contained in the storage container and a refrigerator having the same.

2. Description of the Related Art

Generally, a refrigerator is an appliance, which includes a compressor, a condenser, an expansion valve, and an evaporator, to transfer heat through phase change of a refrigerator, and maintains various food articles in a fresh state for a prolonged period of time through the heat transfer.

Recently, a Kimchi refrigerator has been developed to season Kimchi and to store the seasoned Kimchi in a fresh state, using the above-mentioned refrigerator principle.

Such a Kimchi refrigerator is configured to appropriately season Kimchi in accordance with change of the season and taste of the consumer, and to maintain the seasoned Kimchi at an appropriate temperature, in order to maintain the taste of the appropriately-seasoned Kimchi for a prolonged period of time.

Kimchi is not only a salted food article, which is prepared with salt to increase preservability thereof, but also a fermented food article produced using zymolysis of bacteria. Since the fermentation rate of such Kimchi is varied in accordance with salinity and temperature, a device for measuring the storage state of Kimchi including the salinity, acidity, and temperature of the stored Kimchi is used to establish an optimal storage condition.

SUMMARY

It is an aspect to provide a refrigerator including a storage container having a sensor device to detect a state of salted food stored in the storage container.

It is another aspect to provide a sensor device capable of achieving an enhancement in productivity and compactness.

It is another aspect to provide a storage container having a sensor device capable of providing user convenience.

In accordance with one aspect, a refrigerator includes a storage container having a storage space to store food, and a sensor device comprising a case, a plurality of electrode terminals, and a battery mounted in the case, to apply a voltage to the electrode terminals, wherein the sensor device is detachably mounted to the storage container.

The storage container may be provided with a sensor seat formed at one surface of the storage container, to allow the sensor device to be seated on the sensor seat.

The sensor seat of the storage container may be formed at the surface of the storage container in the form of a recess.

The sensor seat of the storage container may be provided with a plurality of measurement terminals to come into contact with the electrode terminals of the sensor device.

The sensor seat may have steps, at which the measurement terminals are arranged.

The refrigerator may further include a coupling unit to separably couple the sensor device to the sensor seat, wherein the coupling unit comprises a fitting slot provided at one of the sensor seat and the sensor device, and a fitting protrusion provided at the other one of the sensor seat and the sensor device.

The refrigerator may further include a sensor cover to close the sensor seat, thereby preventing the sensor device from being separated from the sensor seat.

The refrigerator may further include an engagement unit to detachably mount the sensor cover, wherein the engagement unit comprises an engagement protrusion provided at one of the sensor seat and the sensor cover, and an engagement groove provided at the other one of the sensor seat and the sensor cover.

The sensor seat may be formed at a bottom wall of the storage container or a side wall extending around the bottom wall.

The sensor device may further include a charging circuit to charge the battery. The sensor device may be charged by an external charger after being separated from the storage container.

The sensor device may further include separate charging terminals connected to the external charger.

The sensor device may be connected to the external charger via the electrode terminals.

The external charger may be provided at the refrigerator in an integrated manner.

The external charger may include a sensor receiver to receive the sensor device, and a plurality of charging electrodes provided at the sensor receiver.

The refrigerator may further include a charger cover to cover the sensor receiver.

In accordance with another aspect, a sensor device includes a chargeable battery, a salinity measurer to measure a salinity of an object to be measured, using a voltage supplied from the chargeable battery, a charger to charge the chargeable battery, and an electrode terminal to be electrically connected to the salinity measurer and the charger.

The electrode terminal may include a plurality of electrodes. The electrodes may have a charging electrode function to charge the chargeable battery when the electrode terminal comes into contact with an external charging terminal.

The charger may include first and second diodes connected to the electrodes in series. The first and second diodes may be connected to positive (+) and negative (−) terminals of the chargeable battery, respectively.

The charger may include a diode and a switch, which are connected to the electrodes in series. The switch may include an insulated gate bipolar transistor (IGBT) or a metal oxide semiconductor field effect transistor (MOSFET).

The electrode terminal may include a plurality of electrodes. The electrodes may have a sensor electrode function to measure the salinity of the object to be measured when the electrode terminal comes into contact with a sensor terminal.

The salinity measurer may include a drive circuit to supply AC current to the electrode terminal, thereby enabling measurement of an electric conductivity variation occurring at the electrode terminal in accordance with a variation in salinity, a duty detector to detect a duty ratio varying in accordance with the salinity variation, and a controller to calculate a salinity value in accordance with the duty ratio detected by the duty detector.

The drive circuit may include first and second switching elements to alternately perform switching operations in accordance drive pulse signals output from the controller, thereby generating AC current, and a capacitor to perform a charging or discharging operation in accordance with alternate switching operations of the first and second switching elements.

The duty detector may include a reference voltage source to supply a reference voltage, in order to cause the salinity-depending electric conductivity variation to be proportional to a variation in duty ratio, using a reference potential, and a comparator to compare, with the reference voltage, a voltage received from the electrode terminal, which has a resistance varying in accordance with the salinity variation.

The controller may receive the duty ratio value output from the comparator, and may calculate a salinity value based on the duty ratio value, thereby measuring the salinity of the object.

In accordance with another aspect, a storage container for a refrigerator includes a storage space to store food, a sensor seat provided at one side of the storage space, to receive a sensor device to measure a state of the food, and a coupling unit provided at the sensor seat, to separably couple the sensor device to the sensor seat.

The sensor seat may be formed at one surface of the storage container in the form of a recess.

The sensor device may include a plurality of electrode terminals. The sensor seat may be provided with a plurality of measurement terminals in a buried manner. The measurement terminals may come into contact with the electrode terminals.

The measurement terminals may have an inter-center distance of 12 mm to 15 mm.

The sensor seat may have steps, at which the measurement terminals are arranged.

The steps may have a height of at least 2 mm.

The coupling unit may include a fitting slot provided at one of the sensor seat and the sensor device, and a fitting protrusion provided at the other one of the sensor seat and the sensor device.

The storage container may further include a cover to close the sensor seat, thereby preventing the sensor device from being separated from the sensor seat.

The sensor device may include a plurality of electrode terminals. The sensor device may be arranged to be directed to a bottom surface of the storage space when the sensor device is mounted to the sensor seat. The sensor seat may be provided with spacing ribs to space the electrode terminals from the bottom surface.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Hereinafter, a refrigerator according to an exemplary embodiment will be described with reference to the accompanying drawings.

The following description will be given in conjunction with a Kimchi refrigerator to store salted food, etc., as the refrigerator according to the embodiment.

Figure 1:
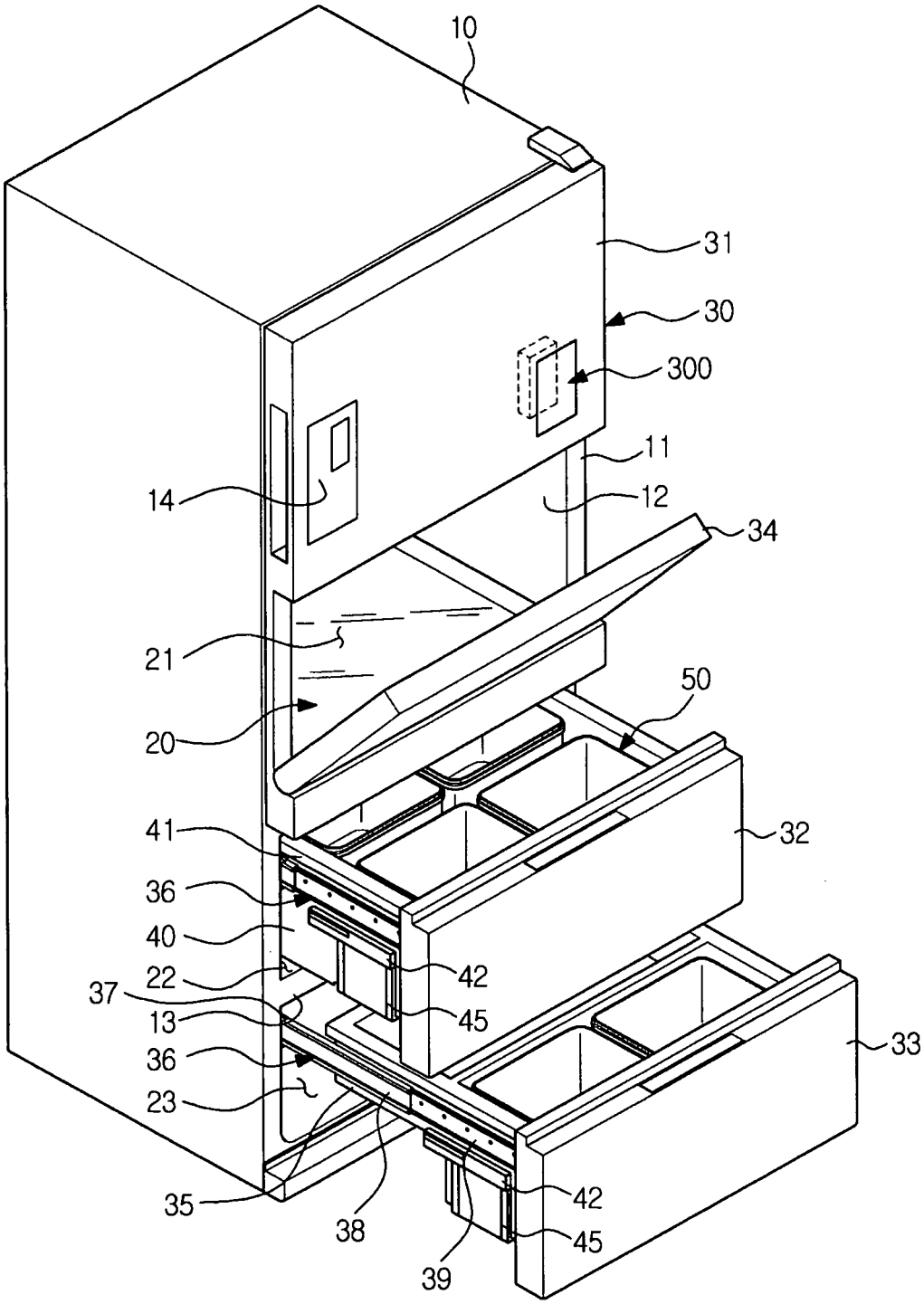
FIG. 1 is a perspective view schematically illustrating a structure of a refrigerator according to an exemplary embodiment.

FIG. 1 is a perspective view schematically illustrating a structure of a refrigerator according to an exemplary embodiment.

Referring to FIG. 1, the refrigerator according to the illustrated embodiment may include a body 10 defining a storage compartment 20, and a door 30 mounted to the body 10, in order to open or close the storage compartment 20.

The body 10 may include an outer case 11 to form an outer appearance, an inner case 12 installed within the outer case 11, to define the storage compartment 20, and a machinery compartment (not shown) to receive a plurality of mechanical or electric elements.

A foam may be filled between the outer case 11 and the inner case 12, to maintain the storage compartment 20 in an insulated state.

The storage compartment 20 may include an upper storage compartment 21, an intermediate storage compartment 22, and a lower storage compartment 23, which are partitioned by a plurality of horizontal partition walls 13. The upper storage compartment 21, intermediate storage compartment 22, and lower storage compartment 23 form independent storage spaces, respectively. The storage temperature of each storage compartment 21, 22, or 23 may be independently controlled in accordance with the amount of cold air supplied to the each storage compartment.

Evaporators (not shown), through which a refrigerant flows, may be installed between the outer case 11 and the inner case 12 in regions where the intermediate and lower storage compartments 22 and 23 are defined, in order to maintain the storage compartments 22 and 23 in low temperature states, respectively. These evaporators may be arranged to be in contact with an inner wall surface of the inner case 12 while surrounding opposite side surfaces and lower surfaces of the storage compartments 22 and 23, respectively.

A heater (not shown), which may include an electric heating wire, may be installed between the outer case 11 and the inner case 12. When it is desired to season Kimchi in the refrigerator, the heater heats the storage compartments 22 and 23, to maintain the storage compartments 22 and 23 at a temperature appropriate for seasoning.

In the machinery compartment, a compressor (not shown) to compress a refrigerant, a condenser (not shown) to condense the refrigerant supplied from the compressor, and others may be arranged. The machinery compartment is defined separately from the storage compartment 20.

The door 30 may include a hinged door 31 pivotally coupled to the body 20, to open or close the upper storage compartment 21, and drawer type doors 32 and 33 slidably coupled to the body 10, to open or close the intermediate storage compartment 22 and lower storage compartment 23, respectively.

An auxiliary door 34 may be provided at the hinged door 31. The auxiliary door 34 pivots vertically about a lower hinge shaft (not shown), to open or close a portion of the upper storage compartment 21. The auxiliary door 34 may be configured to function as a rack capable of allowing an article to be laid thereon in a maximum-opened state.

A control panel 14 may be provided at one side of the hinged door 31. The control panel 14 may allow selection of the kind, seasoning time, and temperature condition of food, and display the selected information.

The drawer type doors 32 and 33 are arranged to be slidably moved in forward and rearward directions of the storage compartments 22 and 23 by a plurality of sliding units 36, respectively. Thus, the drawer type doors 32 and 33 may enter or exit the storage compartments 22 and 23, respectively. Baskets 40 may be detachably mounted to each of the drawer type doors 32 and 33.

To this end, a plurality of seat frames 35 may be mounted to a rear wall of each drawer type door 32 or 33 at opposite sides of the drawer type door 32 or 33. The sliding unit 36 may be mounted to the seat frames 35.

The sliding unit 36 may have a triple rail structure. That is, the sliding unit 36 may include first rails 37 fixedly mounted to opposite side walls of an associated one of the storage compartments 22 and 23, second rails 38 received in the first rails 37 while being movable with respect to the first rails 37, respectively, and third rails 39 received in the second rails 38 while being movable with respect to the second rails 38, respectively. The third rails 39 are fixedly mounted to the seat frames 35.

The sliding unit 36 may be made of a material having high rigidity, for example, stainless steel, in order to be maintained in a sufficiently rigid state even when heavy articles are stored.

The sliding unit 36 may be provided with an automatic door closer 42 to move the associated drawer type door 32 or 33 until the drawer type door 32 or 33 reaches a predetermined point during sliding movement thereof, so as to cause the drawer type door 32 or 33 to close the associated storage compartment 22 or 23.

The automatic door closer 42 may include engagement members (not shown) to restrain each other, and an elastic member (not shown) to pull the associated drawer type door 32 or 33. When the associated drawer type door 32 or 33 reaches a predetermined point, the engagement between the engagement members is released, so that the automatic door closer 42 automatically closes the drawer type door 32 or 33 in accordance with an elastic force of the elastic member.

Each basket 40 may be made of a plastic material. The basket 40 may have an upwardly-opened box shape.

In the basket 40, storage containers 50 to store salted food such as Kimchi, pickles, or salted fish may be received. Flanges 41 may be formed at upper ends of opposite side walls of the basket 40 such that the flanges 41 are integral with the basket 40. The flanges 41 allow the basket 40 to be detachably hung on the seat frames 35.

An auxiliary cooling member 45 may be arranged outside the basket 40 in front of the basket 40. The auxiliary cooling member 45 is in surface contact with opposite outer side surfaces of the basket 40 and an outer bottom surface of the basket 40.

The auxiliary cooling member 45 reduces a temperature distribution deviation occurring in the basket 40. The auxiliary cooling member 45 may include a plate made of a material having high thermal conductivity, such as aluminum.

Figure 2:
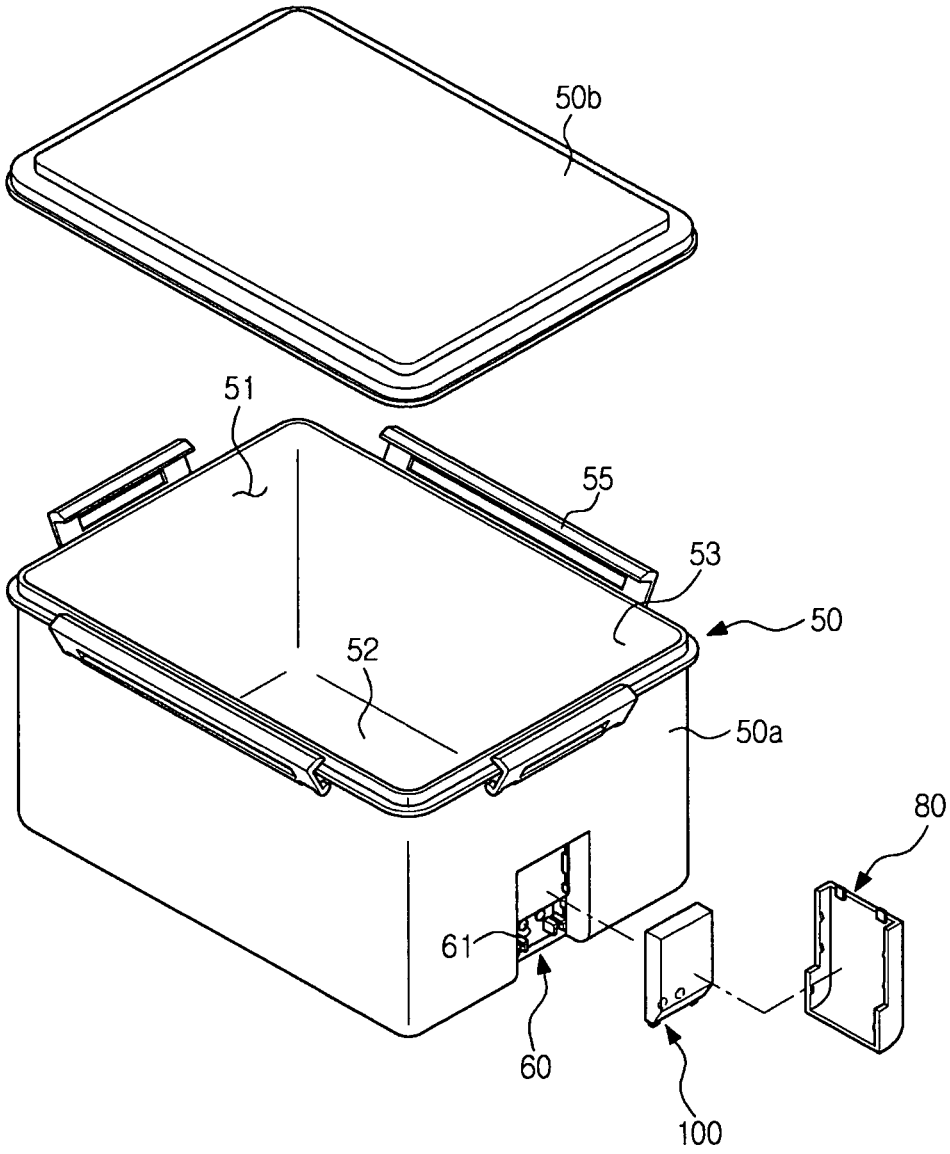
FIG. 2 is an exploded perspective view illustrating a storage container for a refrigerator according to an exemplary embodiment.
Figure 3:
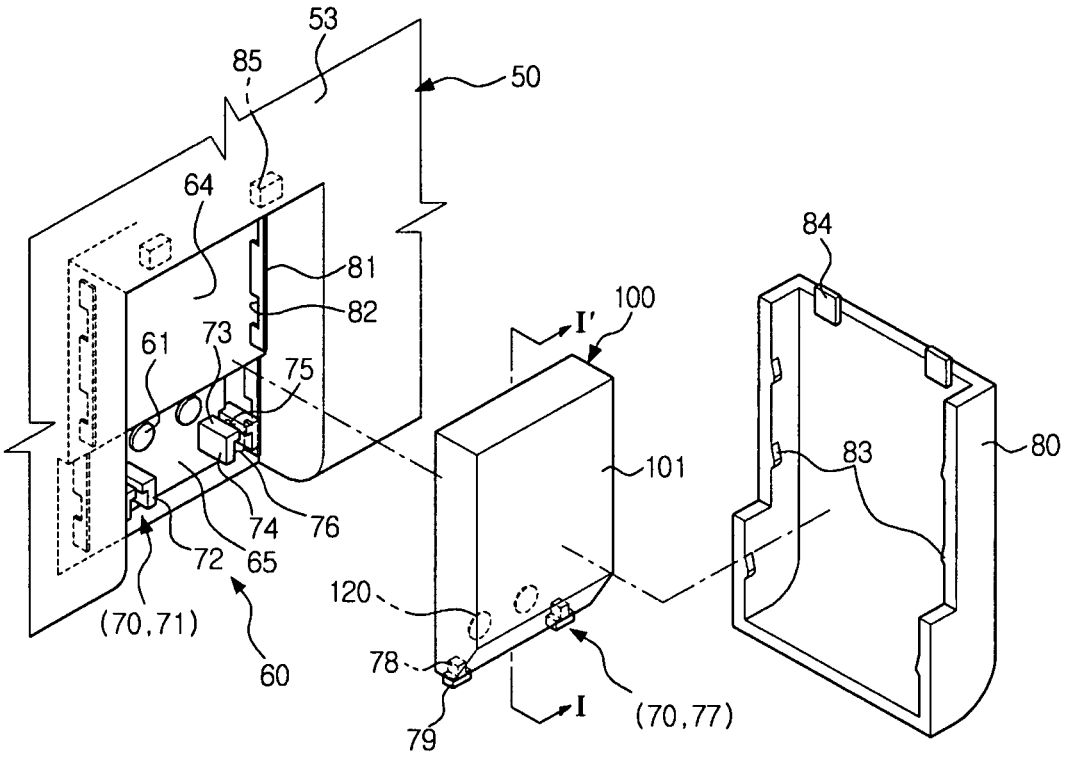
FIG. 3 is a perspective view illustrating a mounting structure for a sensor device according to an exemplary embodiment.
Figure 4:
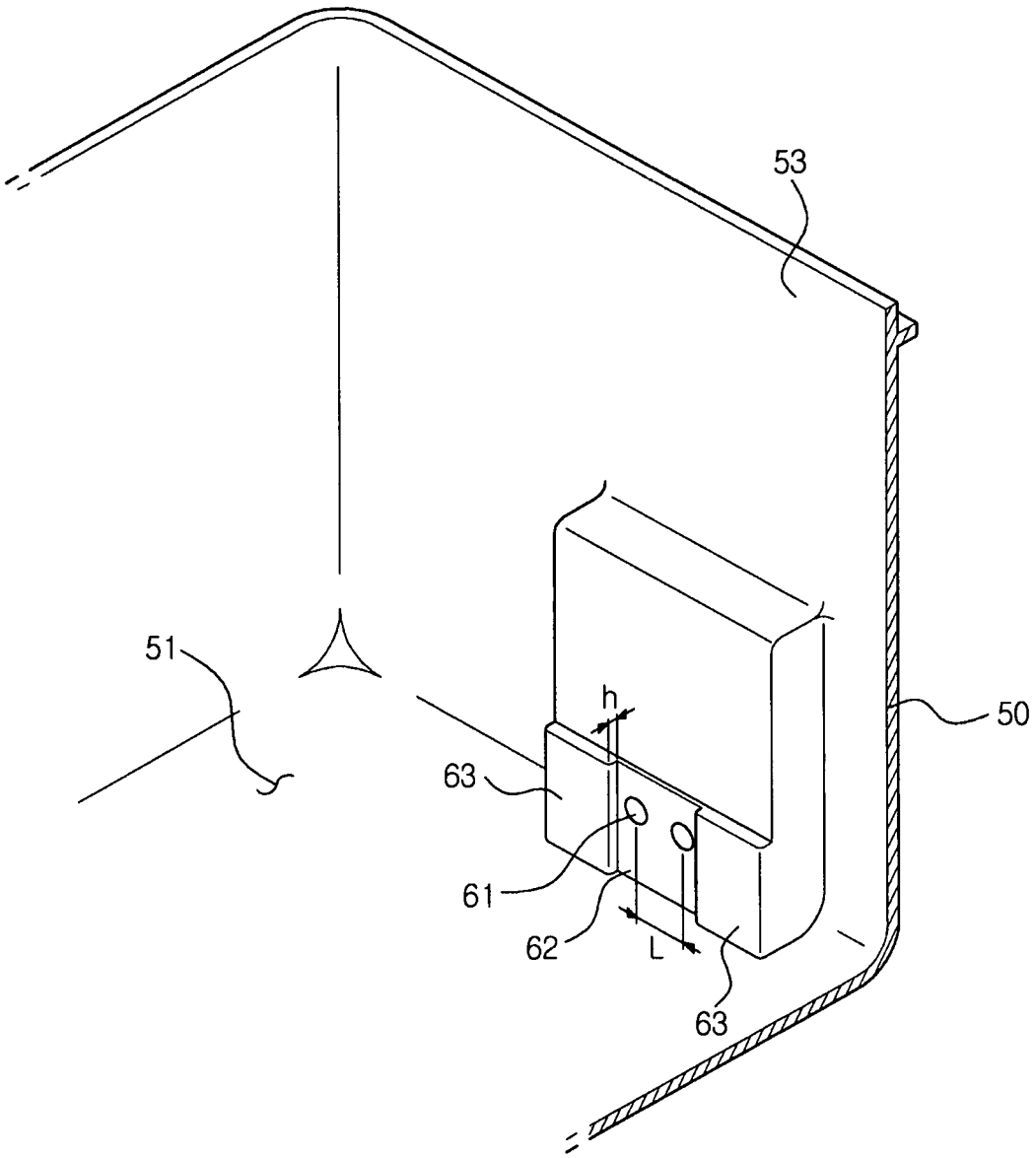
FIG. 4 is a schematic view illustrating a portion of a storage space defined in the storage container according to an exemplary embodiment.
Figure 5:
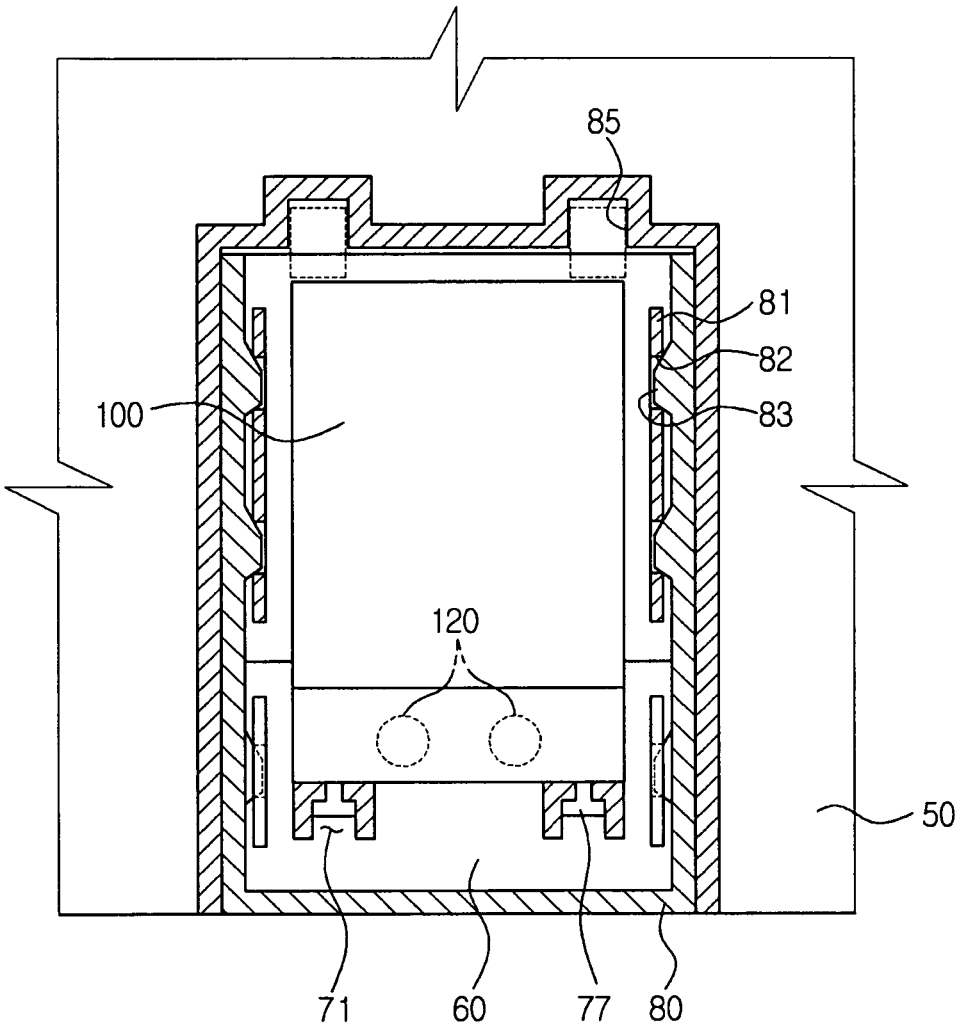
FIG. 5 is a sectional view illustrating a coupled state of the sensor device according to an exemplary embodiment.

FIG. 2 is an exploded perspective view illustrating a storage container for a refrigerator according to an exemplary embodiment. FIG. 3 is a perspective view illustrating a mounting structure for a sensor device according to an exemplary embodiment. FIG. 4 is a schematic view illustrating a portion of a storage space defined in the storage container according to an exemplary embodiment. FIG. 5 is a sectional view illustrating a coupled state of the sensor device according to an exemplary embodiment.

Referring to FIG. 2, the storage container 50 may include a box-shaped container **50*a* defined with a storage space 51 to store food, and a container cover 50*b* detachably coupled to a top of the container 50*a*, to open or close the storage space 51**.

The storage space 51 is opened at the top thereof, to allow food to enter or exit the storage space 51. The storage space 51 may be defined by a bottom wall 52, and a side wall 53 extending upwardly from the periphery of the bottom wall 52.

A plurality of levers 55 are provided at the top of the container **50*a*, and are extended from the container 50*a*. A lever engagement (not shown) may be provided at the periphery of the container cover 50*b***.

A packing member (not shown) may be provided at the periphery of the container cover **50*b*. The packing member may compressively come into contact with the top of the container 50*a* when the container cover 50*b* is secured to the container 50*a*, thereby sealing the storage space 51**.

Meanwhile, salted food containing a liquid component, such as Kimchi, may be stored in the storage space 51. The state of such salted food stored in the storage container 50 may be detected by a sensor device 100 detachably mounted to the storage container 50.

Referring to FIGS. 2 to 4, the sensor device 100 may include a plurality of electrode terminals 120, in order to measure the salinity of food based on a variation in electric conductivity occurring in the sensor device 100 in accordance with the ion concentration of food stored in the storage container 50.

The sensor device 100 may include a case 101 to form an outer appearance, a salinity measurer 140 to perform salinity measurement, based on a signal detected from the electrode terminals 120, a chargeable battery 110 to supply a voltage to the electrode terminals 120, and a charger 130 to charge the chargeable battery 110. The salinity measurer 140, chargeable battery 110, and charger 130 may be mounted in the case 101.

Figure 14:
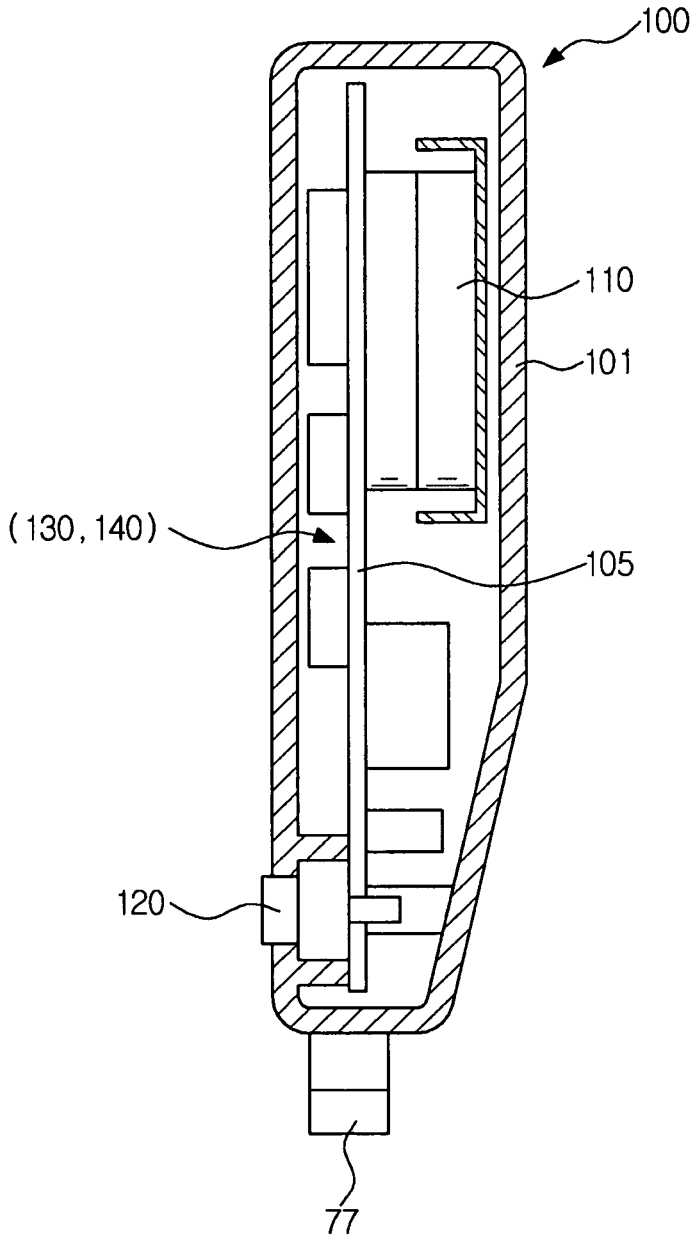
FIG. 14 is a cross-sectional view taken along the line I-I' of FIG. 3.

More specifically, a circuit board 105 is arranged in the case 101, as shown in FIG. 14. The salinity measurer 140, chargeable battery 110, and charger 130 may be formed on the circuit board 105 as an integrated structure. They may be insert-molded upon molding the case 101, so as to be integrated with the case 101. Thus, it may prevent moisture from penetrating the resultant circuit.

Figure 12:
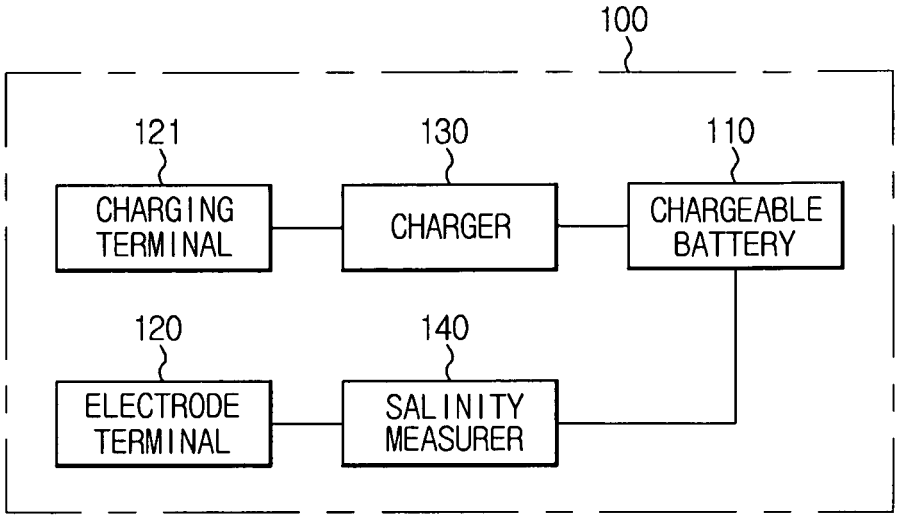
FIG. 12 is a block diagram illustrating a control configuration for salinity measuring and battery charging operations in the sensor device according to an exemplary embodiment.

The charger 130 may include separate charging terminals 121 (FIG. 12). The charger 130 may be connected with external charging terminals via the charging terminals 121, to charge the chargeable battery 110. The charger 130 may be inserted-molded to form an integrated structure in which only the electrodes 120 and charging terminals 121 are outwardly exposed.

The electrode terminals 120 may also be used as charging terminals for charging the chargeable battery 110 in addition to measuring salinity. That is, it may achieve salinity measurement and electric charging, using the electrode terminals 120. Thus, it may reduce the size of the sensor device 100 because the separate charging terminals may be dispensed with. The salinity measurer 140 and charger 130 will be described hereinafter.

A sensor seat 60 may be arranged at one side of the storage container 50, to receive the sensor device 100 such that the sensor device 100 is seated in the sensor seat 60. The sensor seat 60 may be formed at one side of the side wall 53 in a recessed state. The sensor seat 60 may have a shape corresponding to that of the sensor device 100.

A plurality of measurement terminals 61 may be arranged at the sensor seat 60. The measurement terminals 61 may come into contact with the electrode terminals 120 of the sensor device 100, in order to measure the state of food stored in the storage space 51 by way of electric conductivity.

The measurement terminals 61 may be buried in the storage container 50. In this case, one end of each measurement terminal 61 may be exposed to the storage space 51, so as to come into contact with the liquid component of food stored in the storage space 51, whereas the other end of each measurement terminal 61 may be exposed to the outside of the sensor seat 60, so as to come into contact with the associated electrode terminal 120 of the sensor device 100.

The measurement terminals 61 allow current to flow through the liquid component of the food stored in the storage space 51. The measurement terminals 61 may be made of titanium (Ti) and coated with platinum, in order to have corrosion resistance. The measurement terminals 61 may be arranged at a lower portion of the side wall 53 defining the storage space 51.

The side wall 53 of the storage space 51 may have, at an inner surface thereof, a sensor surface 62, on which the measurement terminals 61 are mounted, and stepped surfaces 63, which are stepped from the sensor surface 62 at opposite sides of the sensor surface 62, respectively.

The measurement terminals 61 may be arranged on the sensor surface 62 such that one end of each measurement terminal 61 is exposed to the sensor surface 62 and come into contact with the liquid component of food stored in the storage space 51.

The stepped surfaces 63 may prevent the measurement terminals 61 exposed to the storage space 51 from directly contacting with salted food (Kimchi, etc.) stored in the storage space 51.

The plurality of the measurement terminals 61 horizontally spaced apart from each other on the sensor surface 62 may be arranged without being protruded from the sensor surface 62. The inter-center distance L between the measurement terminals 61 may be 12 mm to 15 mm, for example.

Each measurement terminal 61 may have a circular cross-section or an oval cross-section.

Where each measurement terminal 61 has a protruded structure having an oval cross-section, the measurement sensitivity of the measurement terminal 61 may be improved, as compared to the case in which the measurement terminal 61 has a circular cross-section.

The height difference h between the sensor surface 62 and the stepped surface 63 may be at least 2 mm. At this height difference, it may sufficiently protect each measurement terminal 61 from an obstacle, and thus reduce a measurement error of the measurement terminal 61 occurring upon sensing the state of the stored food.

Meanwhile, the sensor device 100 may be detachably mounted to the sensor seat 60, which is provided at one side of the storage container 50, as shown in FIG. 3. In this case, it may easily mount the sensor device 100 to the storage container 50 and separate the sensor device 100 upon charging the chargeable battery 110 of the sensor device 100.

The sensor seat 60 may include a first support surface 64 to support an upper end of the case 101 of the sensor device 100, and a second support surface 65 stepped from the first support surface 64, to support a lower end of the case 101 of the sensor device 100. The first support surface 64 is opened at one side thereof. Each measurement terminal 61 may be arranged on the second support surface 65 such that the one end of the measurement terminal 61 is protruded from the second support surface 65.

The sensor device 100 may be separably coupled to the sensor seat 60 by a coupling unit 70 after being inserted into the sensor seat 60 through an opened portion of the sensor seat 60.

The coupling unit 70, which separably couples the sensor device 100 to the sensor seat 60, may include a plurality of fitting slots 71 respectively formed through a lower portion of the second support surface 65 at opposite sides of the second support surface 65, and a plurality of fitting protrusions 77 respectively protruded from the lower end of the case 101 of the sensor device 100 at opposite sides of the case 101.

Each fitting slot 71 may be formed between a plurality of fitting ribs 72 protruded from the second support surface 65. Each fitting rib 72 may have an L-shaped cross section.

Each fitting rib 72 may have a horizontal surface 73 extending horizontally to support a lower surface of the case 101, a vertical surface 74 extending vertically from an end of the horizontal surface 73. The fitting ribs 72 may define a first slot 75 and a second slot 76 between the horizontal and vertical surfaces thereof.

The fitting protrusions 77 have a shape corresponding to the fitting slots 71, so as to be fitted into the fitting slots 71, respectively. Each fitting protrusion 77 may have a first protrusion 78 to be fitted into the first slot 75, and a second protrusion 79 to be fitted into the second slot 76. The second protrusion 79 has a size larger than the first protrusion 78.

In accordance with the above-described structures, when the sensor device 100 is inserted into the sensor seat 60 through the opened portion of the sensor seat 60, the fitting protrusions 77 of the sensor device 100 are fitted into the fitting slots 71, as shown in FIG. 5. As a result, the sensor device 100 is securely held in the sensor seat 60 and the electrode terminals 120 of the sensor device 100 are in contact with the measurement terminals 61 arranged at the sensor seat 60.

Although the coupling unit 70, which detachably mount the sensor device 100 to the sensor seat 60, includes the fitting slots 71 provided at the sensor seat 60, and the fitting protrusions 77 provided at the sensor device 100 in the illustrated embodiment, the positions of the fitting slots 71 and fitting protrusions 77 may be varied.

Although not shown in the illustrated embodiment, the coupling unit 70, which is provided as a structure to detachably couple the sensor device 100, may have a hook type engagement structure. That is, any conventional coupling structure may be applied to the illustrated embodiment, so long as it may detachably mount the sensor device 100 to the storage container 50 through a simple operation without using any separate tool.

Meanwhile, the storage container 50 may further include a sensor cover 80 separably coupled to the sensor seat 60, to close the opened portion of the sensor seat 60. The sensor cover 80 may provide improved appearance to the storage container 50 while achieving firm mounting of the sensor device 100.

The sensor cover 80 has a shape corresponding to the sensor seat 60. The sensor cover 80 may be separably coupled to the sensor seat 60 by an engagement unit.

The engagement unit may include engagement ribs 81 extending longitudinally from opposite sides of the sensor seat 60 while having a plurality of engagement grooves 82, and a plurality of engagement protrusions 83 extending from opposite sides of the sensor cover 80, to be engaged with the engagement grooves 82 when the sensor cover 80 is mounted.

The engagement unit may also include a plurality of fitting ribs 84 protruded from opposite upper portions of the sensor cover 80, and a plurality of fitting grooves 85 formed at an upper portion of the sensor seat 60, to receive the fitting ribs 84, respectively. The fitting ribs 84 may easily achieve mounting of the sensor cover 80 by guiding the sensor cover 80 to a position where the sensor cover 80 will be mounted.

When the sensor cover 80 is mounted, the engagement protrusions 83 of the sensor cover 80 are inserted into the engagement grooves 82 while being slightly elastically deformed, in accordance with the above-described configuration, as shown in FIG. 5, so that the engagement protrusions 83 are engaged with the engagement grooves 82. In this case, the inner surface of the sensor cover 80 comes into close contact with the outer surface of the sensor device 100 while pressing the sensor device 100. As a result, contact between the measurement terminals 61 and the electrode terminals 120 may be more securely maintained.

Figure 6:
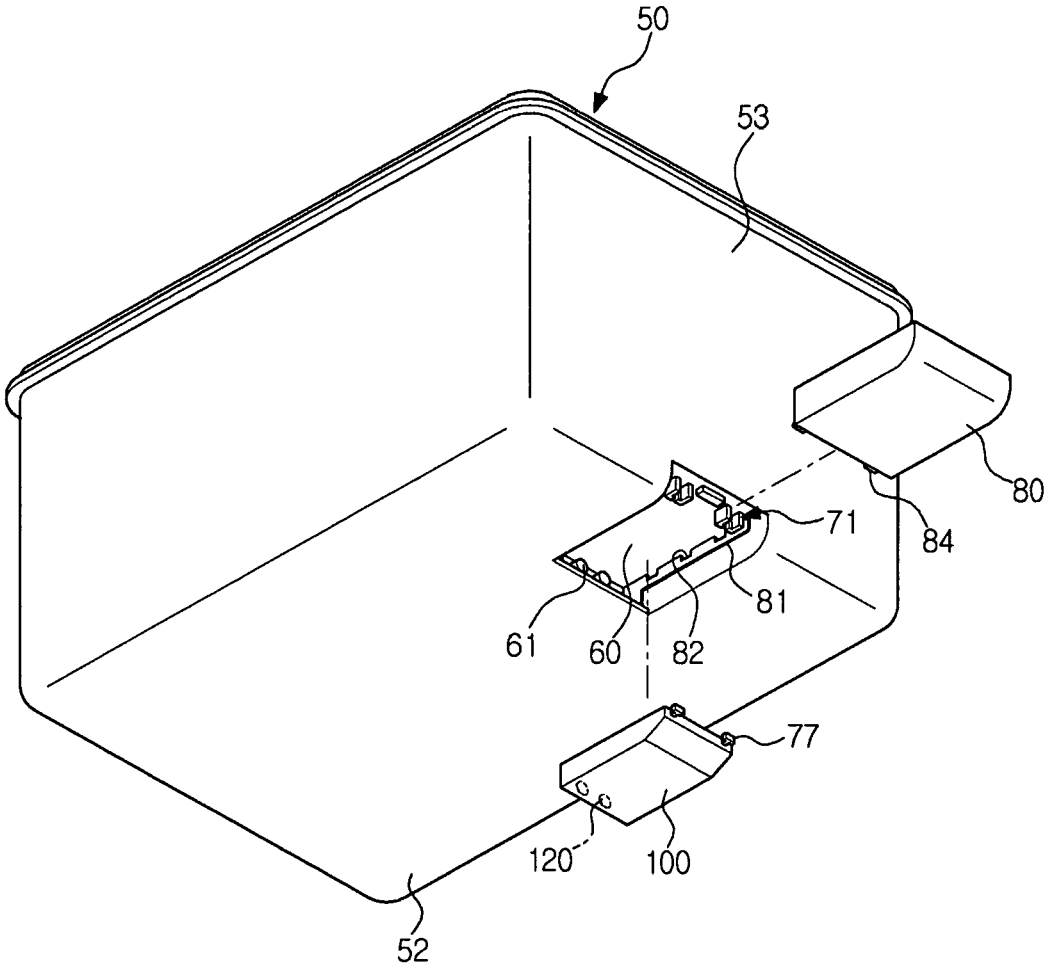
FIG. 6 is an exploded perspective view illustrating a mounting structure for the sensor device according to another exemplary embodiment.

Meanwhile, although the sensor seat 60, in which the sensor device 100 is separably mounted, is formed at one side of the side wall 53 defining the storage space 51, in the case of FIG. 2, the sensor seat 60 may be formed at the bottom wall 52 of the storage container 50, as shown in FIG. 6.

In this case, it may be appreciated that the positions of the measurement terminals 61 provided at the sensor seat 60 and the positions of the electrode terminals 120 of the sensor device 100 may be appropriately varied.

Figure 7:
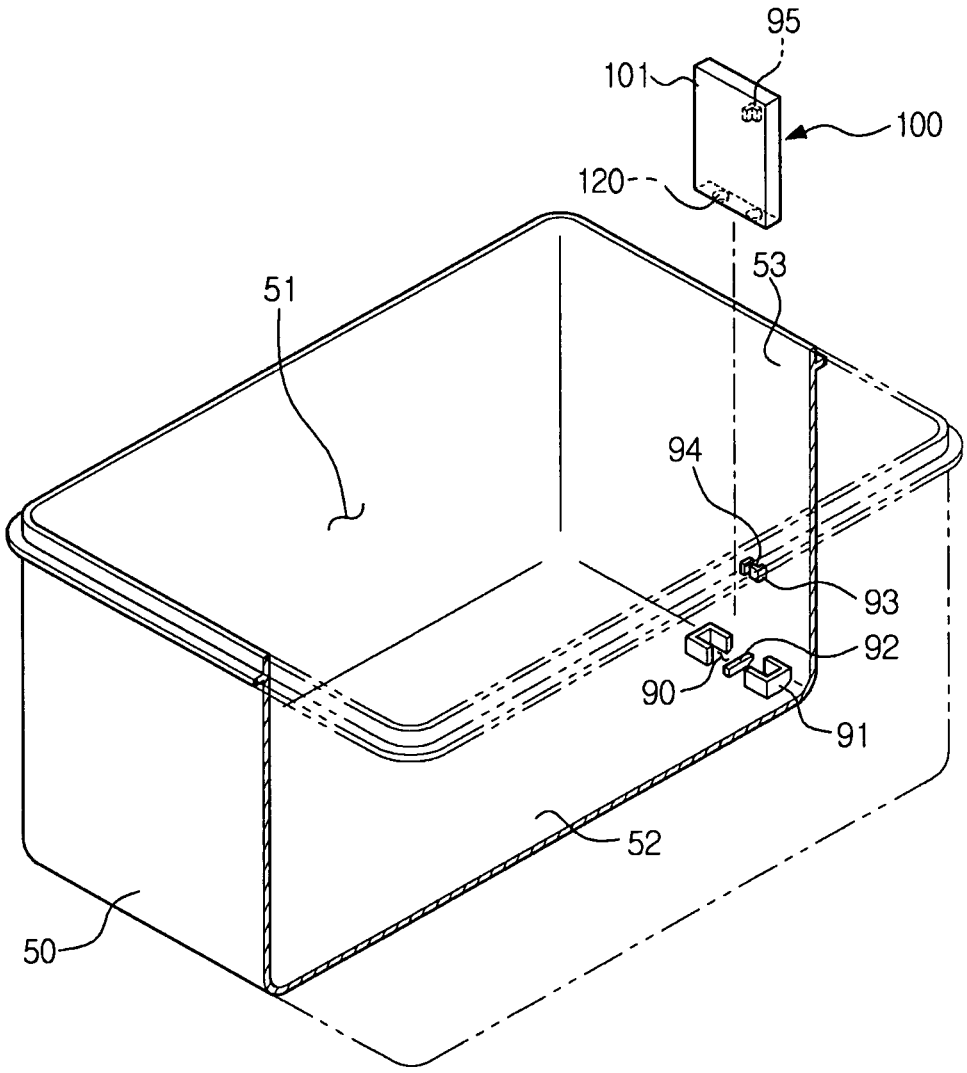
FIG. 7 is an exploded perspective view illustrating a mounting structure for the sensor device according to another exemplary embodiment.

Also, although the sensor device 100 is arranged at the outside of the storage container 50, to be separably coupled to the storage container 50, the sensor device 100 may be arranged in the storage space 51, to be directly separably coupled to the storage container 50, as shown in FIG. 7.

In this case, the measurement terminals 61, which come into contact with the electrode terminals of the sensor device 100, may be dispensed with. A sensor seat 90 may also be formed between a plurality of fitting ribs 91 extending vertically in the vicinity of an edge of the bottom wall 51, to receive a lower end of the sensor device 100. The sensor seat 90 may have a width slightly smaller than a lower end of the case 101 of the sensor device 100 such that the sensor device 100 may be forcibly fitted into the sensor seat 90.

The electrode terminals 120 of the sensor device 100 may be arranged at a lower end of the case 101. A fitting rib 95 may be outwardly protruded from an outer surface of the upper portion of the case 101.

The sensor seat 90 may include a fitting rib 93 protruded from an upper portion of the side wall 53 to form a fitting groove 94 to receive the fitting rib 95 of the sensor device 100.

The sensor seat 90 may further include a spacing rib 92 upwardly protruded from the bottom wall 52. When the sensor device 100 is mounted to the sensor seat 90, the spacing rib 92 spaces the electrode terminals 120 of the sensor device 100 from the bottom wall 52. Thus, the measurement reliability of the sensor device 100 may be enhanced.

Through the above-described configurations, the sensor device 100 may be separably mounted to the sensor seat 90 as it is downwardly inserted into the sensor seat 90. In this case, the fitting rib 95 of the sensor device 100 is fitted into the fitting groove 94. Accordingly, the mounting of the sensor device 100 may be more secure.

Hereinafter, configurations of the salinity measurer and charger of the sensor device according to an exemplary embodiment will be described.

Figure 8:
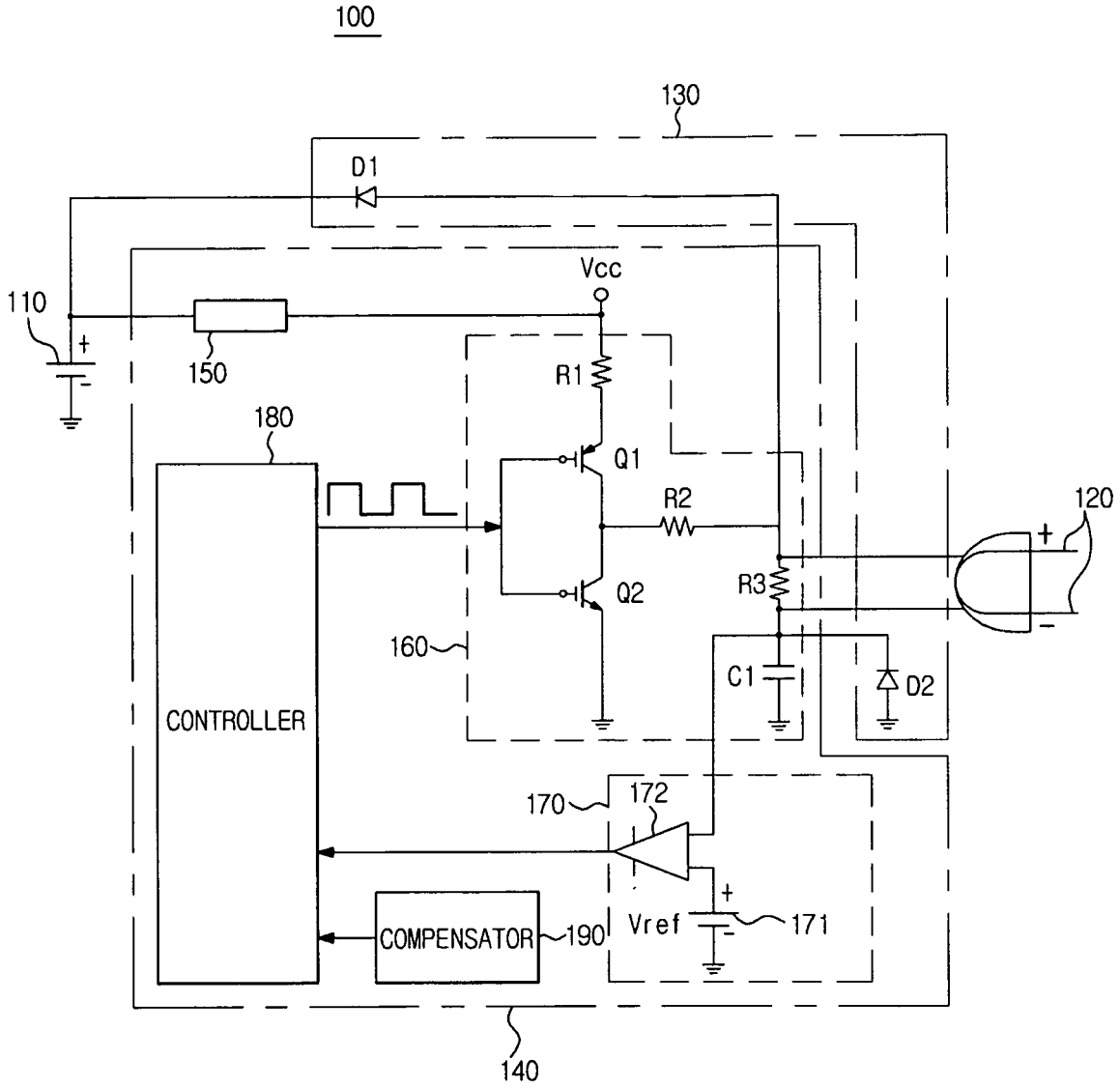
FIG. 8 is a circuit diagram illustrating configurations of a salinity measurer and charger included in the sensor device according to an exemplary embodiment.

FIG. 8 is a circuit diagram illustrating configurations of the salinity measurer and charger of the sensor device according to an exemplary embodiment.

Referring to FIG. 8, the sensor device 100 according to the illustrated embodiment includes a chargeable battery 110 to supply a voltage, electrode terminals 120 to be used for salinity measurement and charging for the chargeable battery 110, a charger 130 to charge the chargeable battery 110, and a salinity measurer 140 to measure the salinity of an object to be measured.

The chargeable battery 110 supplies a drive voltage Vcc for the sensor device 100.

As described above, the electrode terminals 120 perform a sensing operation to measure the salinity of an object to be measured and a charging operation to charge the chargeable battery 110, using the same electrodes. The electrode terminals 120 include a plurality of electrodes to allow current to flow therebetween.

When the electrode terminals 120, which include a plurality of electrodes (for example, a pair of electrodes), come into contact with charging terminals provided at an external charger or a refrigerator, current flows to the chargeable battery 110 via the charger 130 by a voltage supplied from the outside of the sensor device 100. Thus, the chargeable battery 110 is charged (FIG. 9).

Figure 10:
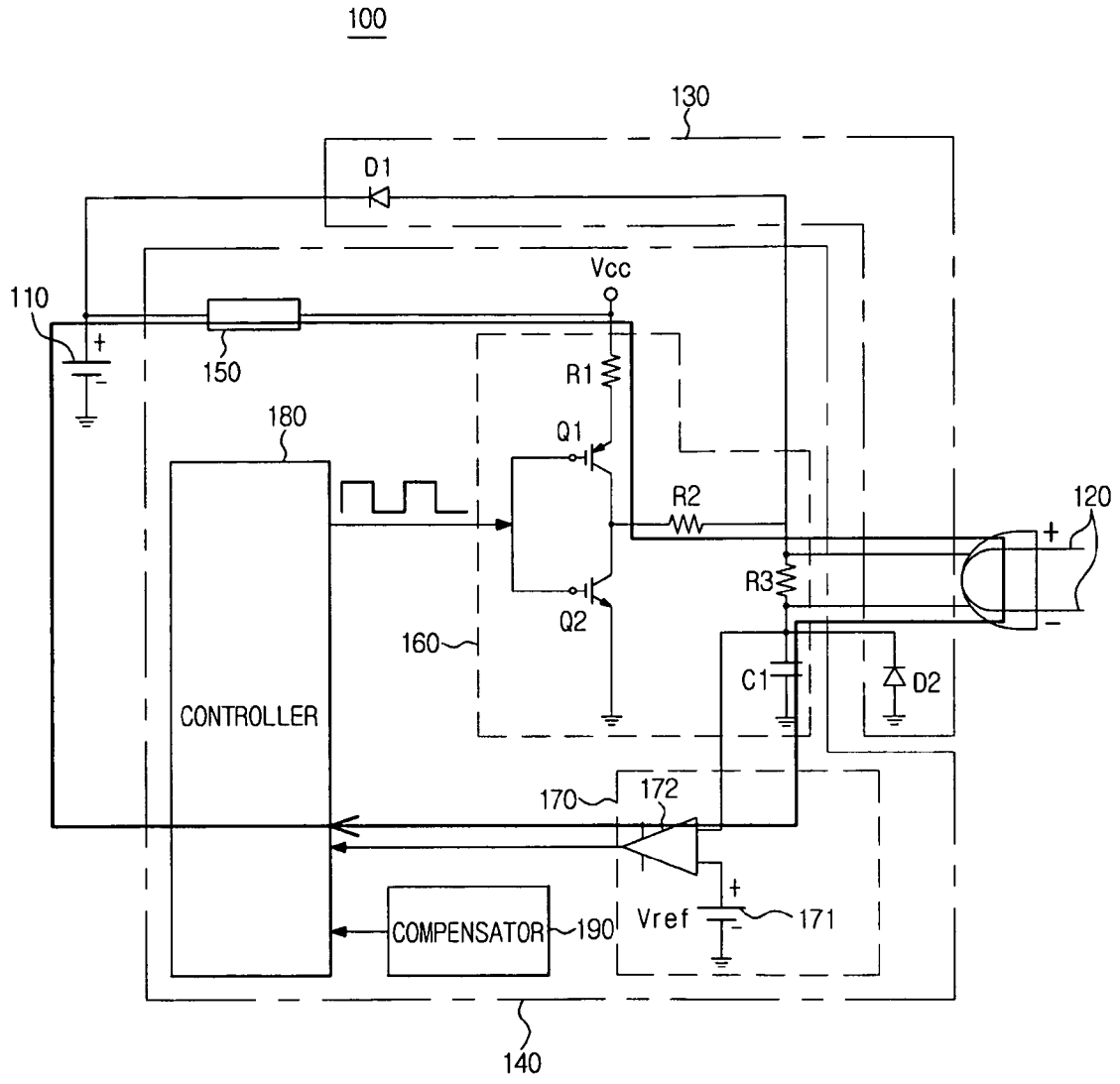
FIG. 10 is a closed loop circuit illustrating a flow of current generated during a salinity measuring operation in the configuration of FIG. 8.

On the other hand, when the electrode terminals 120 come into contact with the measurement terminals 61 provided at the storage container 50, current flows to the electrode terminals 120 via the salinity measurer 140 by the voltage supplied to the chargeable battery 110. In this case, accordingly, it is possible to measure the salinity of salted food stored in the storage container 50 (FIG. 10).

The charger 130 includes first and second diodes D1 and D2 connected to the electrode terminals 120 in series. The first and second diodes D1 and D2 are connected to positive (+) and negative (−) terminals of the chargeable battery 110, respectively.

Figure 9:
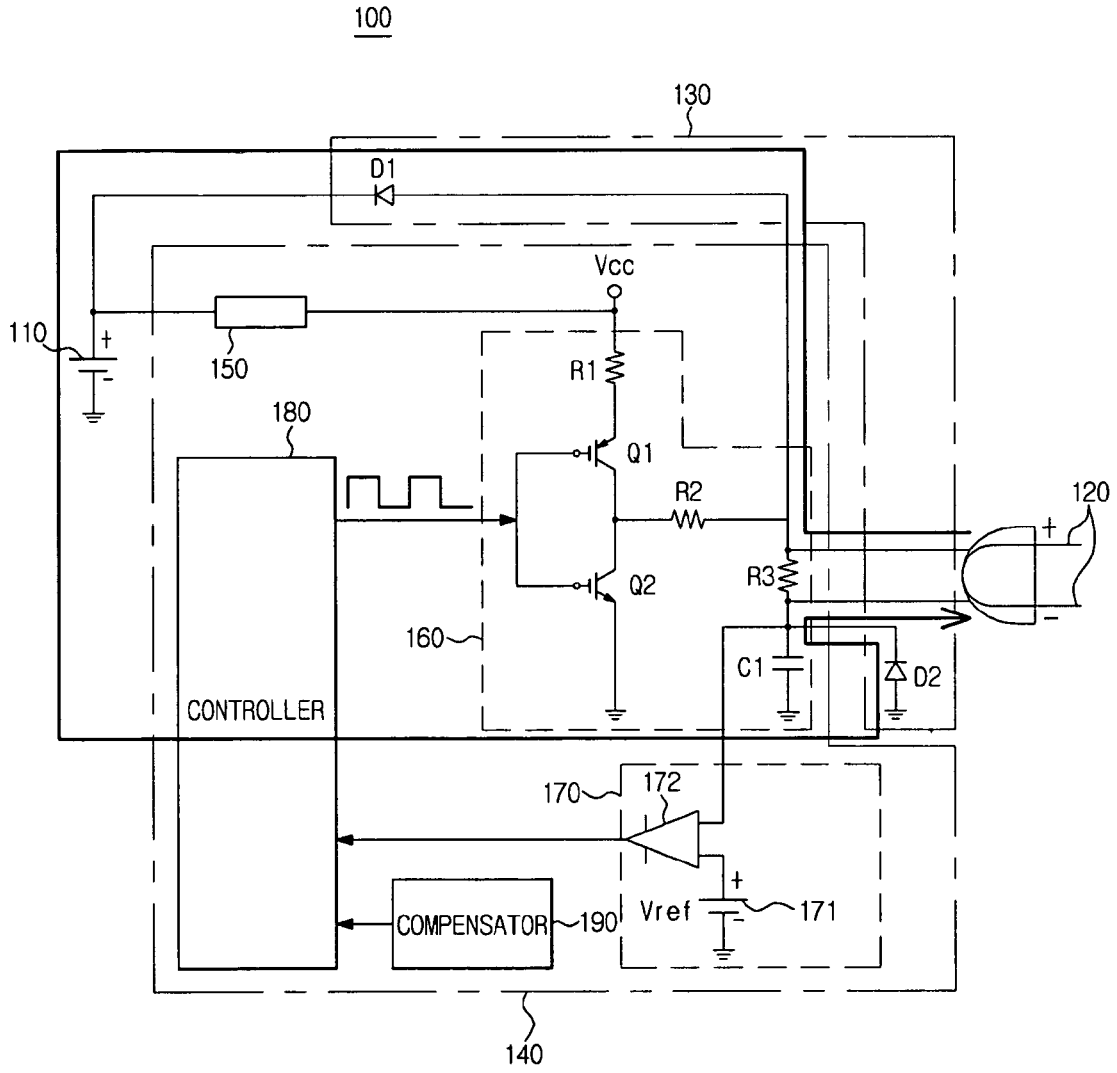
FIG. 9 is a closed loop circuit illustrating a flow of current generated during a battery charging operation in the configuration of FIG. 8.

The charger 130, which includes the first and second diodes D1 and D2, allows current to flow through the first and second diodes D1 and D2 when the electrode terminals 120 come into contact with the charging terminals, thereby charging the charging battery 110 (FIG. 9).

On the other hand, when the electrode terminals 120 come into contact with the sensor electrodes for salinity measurement, the first diode D1 prevents current from flowing to the charging battery 110, to enable the electrode terminals 120 to perform a sensing operation for salinity measurement.

The salinity measurer 140 performs salinity measurement, based on a variation in electric conductivity occurring at the electrode terminals 120 in accordance with an ion concentration of the object to be measured. The salinity measurer 140 includes a regulator 150 to adjust the voltage of the charging battery 110, a drive circuit 160 to supply AC current to the electrode terminals 120, in order to measure a electric conductivity variation occurring at the electrode terminals 120 in accordance with a variation in salinity, a duty detector 170 to detect a duty ratio varying in accordance with the salinity variation, a controller 180 to calculate a salinity value in accordance with the duty ratio detected by the duty detector 170, and a compensator 190 to compensate for the calculated salinity value in accordance with temperature.

The drive circuit 160 of the salinity measurer 140 includes first and second switching elements Q1 and Q2 to alternately perform switching operations in accordance with drive pulse signals output from the controller 180, thereby generating AC current, a capacitor C1 connected to the electrode terminals 120 in series, to perform a charging or discharging operation in accordance with alternate switching operations of the first and second switching elements Q1 and Q2, and current-restricting resistors R1 to R3 connected between the first and second switching elements Q1 and Q2 and the electrode terminals 120, to restrict current components flowing to the electrode terminals 120 in accordance with the alternate switching operations of the first and second switching elements Q1 and Q2.

The capacitor C1 constitutes an RC circuit, together with the electrode terminals 120, which exhibits a variation in resistance in accordance with a variation in electric conductivity depending on salinity. The resistance of the electrode terminals 120 is inversely proportional to salinity. Accordingly, the charging time of the capacitor C1 depends on the time constant of the RC circuit.

The duty detector 170 includes a reference voltage source 171 to supply a reference voltage Vref, in order to cause the salinity-depending electric conductivity variation to be proportional to a variation in duty ratio, using a reference potential, and a comparator 172 to compare, with the reference voltage Vref, a voltage generated in accordance with a variation in the resistance of the electrode terminals 120 depending on a variation in salinity.

The controller 180 receives a duty ratio value output from the comparator 172 of the duty detector 170, and calculates a salinity value based on the received duty ratio value, thereby measuring salinity.

The controller 180 also applies a drive pulse signal having a predetermined frequency to the first and second switching elements Q1 and Q2 of the drive circuit 160, to alternately operate the first and second switching elements Q1 and Q2.

FIG. 9 is a closed loop circuit illustrating a flow of current generated during a battery charging operation in the configuration of FIG. 8.

Referring to FIG. 9, current flows through the positive (+) electrode of the electrode terminals 120 toward the first diode D1 by a voltage supplied from an external voltage source during a charging operation for the chargeable battery 110. The current, which passes through the first diode D1, is applied to the chargeable battery 110, thereby charging the chargeable battery 110. The current applied to the chargeable battery 110, then flows toward the second diode D2 through the ground. The current, which passes through the second diode D2, flows into the negative (−) electrode of the electrode terminals 120. Thus, a closed loop circuit is established.

FIG. 10 is a closed loop circuit illustrating a flow of current generated during a salinity measuring operation in the configuration of FIG. 8.

Referring to FIG. 10, when the first switching element Q1 operates, current flows to the positive (+) electrode of the electrode terminals 120 via the regulator 150 and current-restricting resistors R1 and R2 by a voltage supplied from the chargeable battery 110. The current, which passes through the positive (+) electrode of the electrode terminals 120, is charged in the capacitor C1 after passing through the negative (−) electrode of the electrode terminals 120. In this case, the charging time of the capacitor C1 is varied depending on the time constant determined by the resistance of the electrode terminals 120 and the capacitance of the capacitor C1.

Meanwhile, when the second switching element Q2 operates, current flows to the second switching element Q2 via the current-restricting resistors R3 and R2 by the voltage charged in the capacitor C1. Accordingly, the voltage charged in the capacitor C1 is discharged.

Thus, the voltage, which is charged in the capacitor C1 and then discharged from the capacitor C1 in accordance with alternate switching operations of the first and second switching elements Q1 and Q2, is input to the comparator 172 of the duty detector 170 connected to the capacitor C1.

The comparator 172 compares the input voltage with the reference voltage Vref, thereby outputting a duty ratio value varied in accordance with salinity. The duty ratio value is applied to the controller 180.

The controller 180 receives the duty ratio value output from the comparator 172 of the duty detector 170, and calculates a salinity value based on the received duty ratio value. The controller 180 compensates the calculated salinity value, using the compensator 190, and then determines the salinity of the object to be measured, based on the compensated salinity value.

Figure 11:
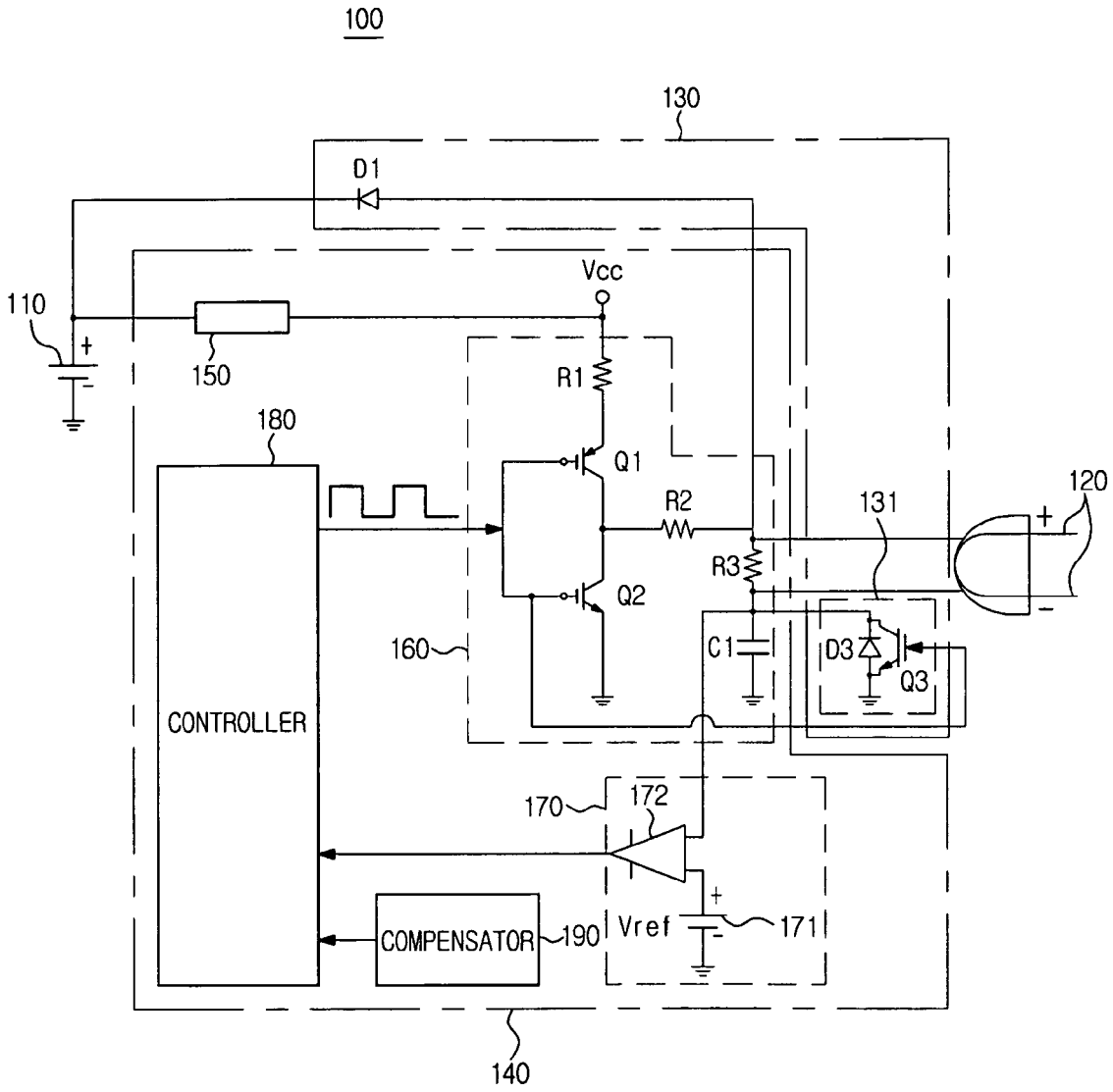
FIG. 11 is a circuit diagram illustrating configurations of the salinity measurer and charger of the sensor device according to another exemplary embodiment.

FIG. 11 is a circuit diagram illustrating configurations of the salinity measurer and charger of the sensor device according to another exemplary embodiment. Constituent elements shown in FIG. 11 are designated using the same terms and reference numerals as those in FIG. 8, to eliminate repetition of description.

Referring to FIG. 11, the charger 130 includes a first diode D1 and a switch 131, which are connected to the electrode terminals 120 in series. The first diode D1 and switch 131 are also connected to the positive (+) and negative (−) terminals of the chargeable battery 110, respectively.

The switch 131 includes a switching element Q3 such as an insulated gate bipolar transistor (IGBT) or a metal oxide semiconductor field effect transistor (MOSFET), and an anti-parallel diode D3 connected to the switching element Q3 in parallel.

Where the charger 130 uses the switch 131 in place of the second diode D2, as shown in FIG. 11, it may be possible to charge the chargeable battery 110 by flowing current to the chargeable battery 110 via the first diode D1 and anti-parallel diode D3 during a charging operation, as in the case of FIG. 1.

On the other hand, the switching element Q3 operates in conjunction with the second switching element Q2 of the drive circuit 160 during a salinity measuring operation, to discharge electric charges of the capacitor C1. In this case, accordingly, the amount of ions present in the electrode terminals 120 may be minimized.

Although the case, in which the salinity measuring operation and battery charging operation are carried out using the electrode terminals 120 electrically connected to the charger 130 and salinity measurer 140, has been described with reference to FIGS. 8 and 11, the case, in which separate terminals for battery charging are provided, will be described with reference to FIG. 12.

FIG. 12 is a block diagram illustrating a control configuration for salinity measuring and battery charging operations in the sensor device according to an exemplary embodiment. Constituent elements shown in FIG. 12 are designated using the same terms and reference numerals as those in FIGS. 8 and 11, to eliminate repetition of description.

Referring to FIG. 12, the sensor device 100 according to the illustrated embodiment includes charging terminals 121 for the charging battery 110, in addition to the electrode terminals 120 for salinity measurement.

Accordingly, when the electrode terminals 120 come into contact with the measurement terminals 61 provided at the storage container 50, current flows to the electrode terminals 120 via the salinity measurer 140 by the voltage supplied to the chargeable battery 110. In this case, accordingly, it is possible to measure the salinity of salted food stored in the storage container 50.

On the other hand, when the charging terminals 121 come into contact with external charging terminals, current flows to the chargeable battery 110 via the charger 130 by a voltage supplied from the outside of the sensor device 100. Thus, the chargeable battery 110 is charged.

Although the case, in which the chargeable battery 110 to supply a drive voltage Vcc for the sensor device 100 is charged in a wired manner, has been described with reference to FIGS. 8 and 11, the case, in which the chargeable battery 110 is charged in a wireless manner, will be described hereinafter with reference to FIG. 13.

Figure 13:
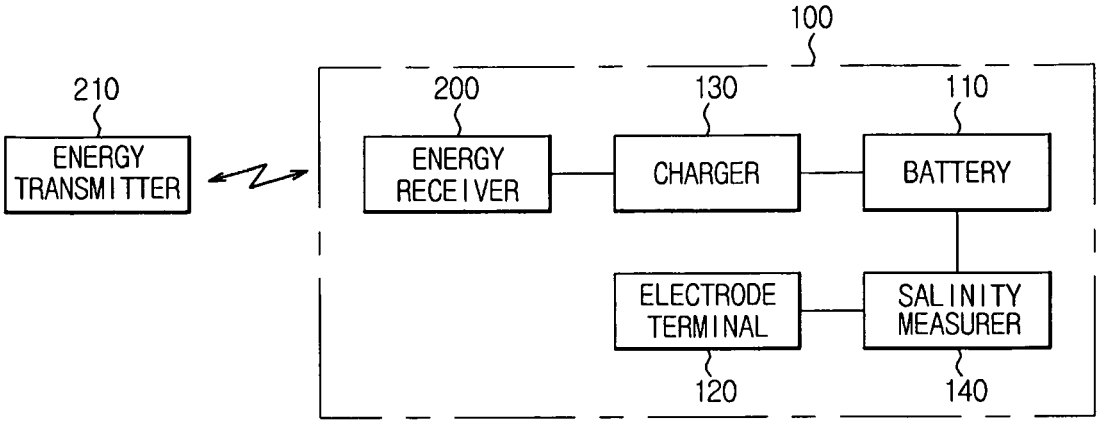
FIG. 13 is a block diagram illustrating a control configuration for a wireless charging operation for a chargeable battery in the sensor device according to an exemplary embodiment.

FIG. 13 is a block diagram illustrating a control configuration for a wireless charging operation for the chargeable battery in the sensor device according to an exemplary embodiment. Constituent elements shown in FIG. 13 are designated using the same terms and reference numerals as those in FIGS. 8 and 11, to eliminate repetition of description.

Referring to FIG. 13, the sensor device 100 further includes an energy receiver 200 to receive energy transmitted from an energy transmitter 210 in a wireless manner.

The energy receiver 200 receives energy transmitted from the energy transmitter 210 in a wireless manner, and applies the received energy to the chargeable battery 110 through the charger 130, thereby charging the chargeable battery 110.

The energy transmitter 210 is electrically connected to an external voltage source, to receive energy. The energy transmitter 210 transmits the received energy in a wireless manner. For the external voltage source, a power source, which externally supplies energy to a general refrigerator, may be used.

Where the voltage of the chargeable battery 110 is charged in a wireless manner, as described above, the electrode terminals 120 of FIG. 13 operate only as sensor electrodes for salinity measurement, different from the cases of FIGS. 8 and 11.

Figure 15:
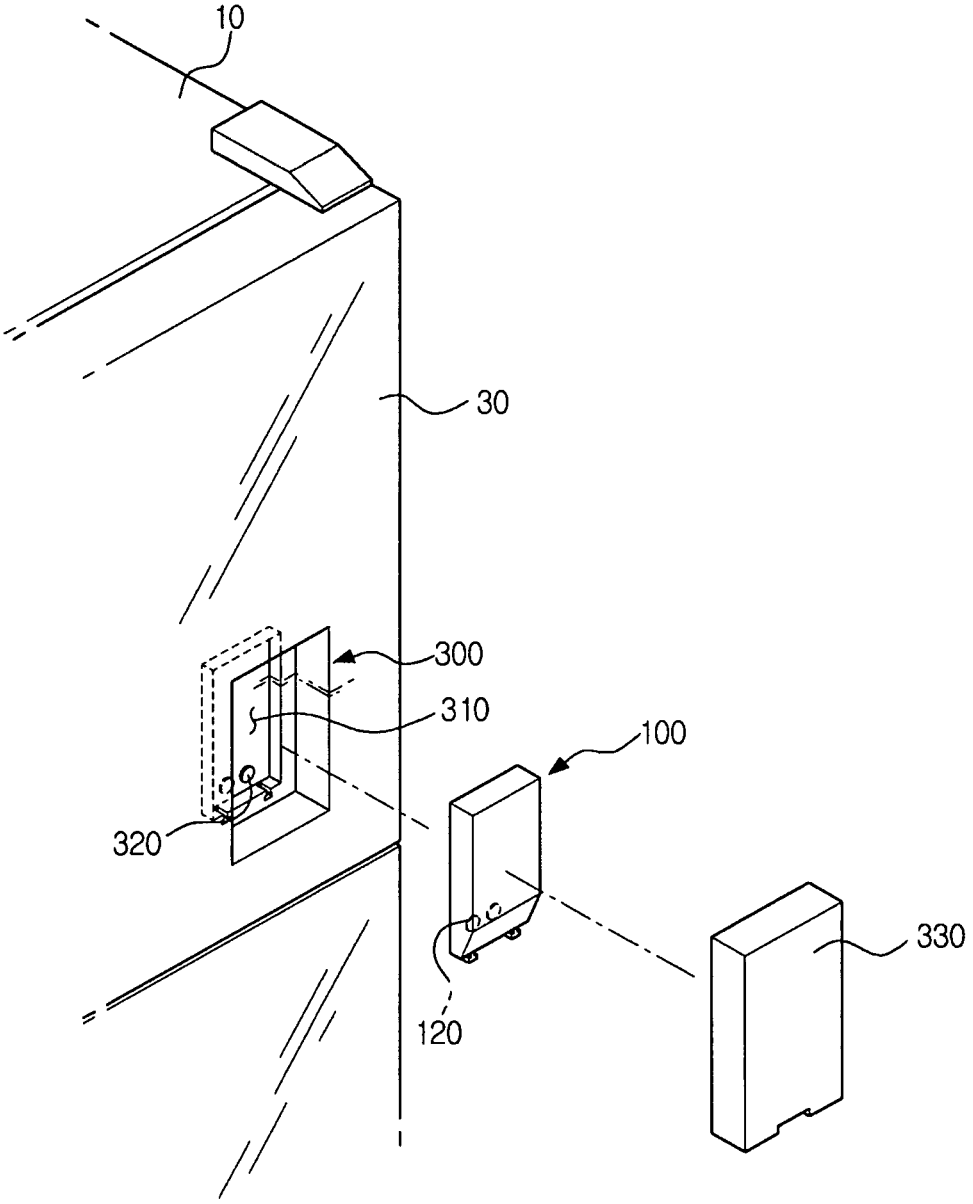
FIG. 15 is an exploded perspective view illustrating a charger provided at a door in accordance with an exemplary embodiment.
Figure 16:
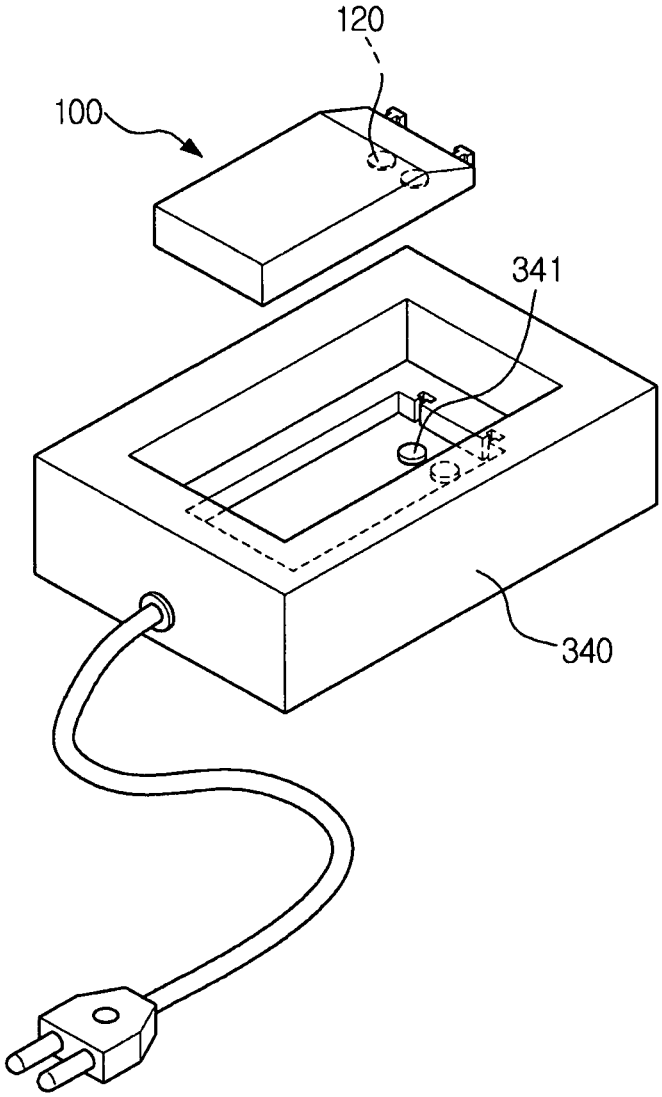
FIG. 16 is an exploded perspective view illustrating a separate charger to charge the sensor device according to an exemplary embodiment.

FIGS. 15 and 16 illustrate an external charger to charge the chargeable battery in a wired manner in the sensor device in accordance with an exemplary embodiment.

Referring to FIG. 15, an external charger 300, which supplies a voltage to the chargeable battery 110 of the sensor device 110, may be provided at the refrigerator in an integrated manner. In the illustrated embodiment, the external charger 300 is provided at the outer surface of the door 30 to open or close the storage compartment. However, the external charger 300 may be provided at an outer surface of the body 10 or at the interior of the body 10.

The charger 300 may include a sensor receiver 310 formed at one side of the outer surface of the door 30 in the form of a recess, to receive the sensor device 100, a plurality of charging electrodes 320 provided at the sensor receiver 310, to come into electrical contact with the electrode terminals 120, and a charger cover 330 to cover a front opening of the sensor receiver 310.

When the sensor device 100 is received in the sensor receiver 310, the electrode terminals 120 of the sensor device 100 come into contact with the charging electrodes 320 of the charger 300. In this state, current flows to the chargeable battery 110 through the charger 130 of the sensor device 100 by a voltage supplied from the external power source. Thus, the chargeable battery 110 is charged.

Although the charger 300 to charge the chargeable battery 110 of the sensor device 100 is provided at the refrigerator in an integrated manner in the illustrated embodiment, a separate charger 340, which includes a plurality of charging electrodes 341 to come into electrical contact with the electrode terminals 120 of the sensor device 100, as shown in FIG. 16, may be used.

As apparent from the above description, the sensor device has a simple, inexpensive, and size-reduced structure.

Also, the storage container provided with the sensor device has user convenience and enhanced reliability.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a storage container comprising a storage space to store food;

a plurality of measurement terminals having ends that are exposed to the storage space; and a sensor device comprising a case, a plurality of electrode terminals, and a battery mounted in the case, to apply a voltage to the plurality of electrode terminals, wherein the sensor device is detachably mounted to the storage container, wherein the plurality of electrode terminals are configured to selectively be used as one of a plurality of charging terminals to charge the battery and a plurality of connecting terminals to connect with the plurality of measurement terminals based on whether the sensor device is detached from the storage container, and wherein an inner surface of the storage container includes a sensor surface adjacent to the ends of the measurement terminals, and the sensor surface includes at least one stepped surface to prevent the ends of the measurement terminals, which are exposed to the storage space, from coming into direct contact with food stored in the storage space.

2. The refrigerator according to claim 1, wherein the storage container includes a sensor seat formed at one surface of the storage container, to allow the sensor device to be seated on the sensor seat.

3. The refrigerator according to claim 2, wherein the sensor seat of the storage container is formed at the surface of the storage container in the form of a recess.

4. The refrigerator according to claim 2, wherein the sensor seat of the storage container is provided with the plurality of measurement terminals to come into contact with the electrode terminals of the sensor device.

5. The refrigerator according to claim 4, wherein the sensor seat includes steps, at which the measurement terminals are arranged.

6. The refrigerator according to claim 2, further comprising:

a coupling unit to separably couple the sensor device to the sensor seat, wherein the coupling unit comprises a fitting slot at one of the sensor seat and the sensor device, and a fitting protrusion at the other one of the sensor seat and the sensor device.

7. The refrigerator according to claim 2, further comprising:

a sensor cover to close the sensor seat, thereby preventing the sensor device from being separated from the sensor seat.

8. The refrigerator according to claim 7, further comprising:

an engagement unit to detachably mount the sensor cover, wherein the engagement unit comprises an engagement protrusion at one of the sensor seat and the sensor cover, and an engagement groove at the other one of the sensor seat and the sensor cover.

9. The refrigerator according to claim 2, wherein the sensor seat is formed at a bottom wall of the storage container or a side wall extending around the bottom wall.

10. The refrigerator according to claim 1, wherein:

the sensor device further comprises a charging circuit to charge the battery; and the sensor device is charged by an external charger after being separated from the storage container.

11. The refrigerator according to claim 10, wherein the sensor device further comprises separate charging terminals connected to the external charger.

12. The refrigerator according to claim 10, wherein the sensor device is connected to the external charger via the electrode terminals.

13. The refrigerator according to claim 10, wherein the external charger is integrated with the refrigerator.

14. The refrigerator according to claim 13, wherein the external charger comprises a sensor receiver to receive the sensor device, and a plurality of charging electrodes provided at the sensor receiver.

15. The refrigerator according to claim 14, further comprising:

a charger cover to cover the sensor receiver.

* * * * *